US012104261B2

(12) United States Patent
Du et al.

(10) Patent No.: US 12,104,261 B2
(45) Date of Patent: Oct. 1, 2024

(54) BISMUTH-DOPED BISMUTH PHOSPHATE PHOTOELECTRODE MODIFIED BY TITANIUM CARBIDE AND PREPARATION METHOD

(71) Applicant: CHANGZHOU INSTITUTE OF TECHNOLOGY, Changzhou (CN)

(72) Inventors: Xiaojiao Du, Changzhou (CN); Junmou Zhu, Changzhou (CN); Jin Xiao, Changzhou (CN)

(73) Assignee: CHANGZHOU INSTITUTE OF TECHNOLOGY, Changzhou (CN)

( * ) Notice: Subject to any disclaimer, the term of this patent is extended or adjusted under 35 U.S.C. 154(b) by 0 days.

(21) Appl. No.: 17/781,010

(22) PCT Filed: Nov. 29, 2021

(86) PCT No.: PCT/CN2021/133961

§ 371 (c)(1),
(2) Date: Nov. 24, 2022

(87) PCT Pub. No.: WO2022/242095

PCT Pub. Date: Nov. 24, 2022

(65) Prior Publication Data

US 2024/0158934 A1 May 16, 2024

(30) Foreign Application Priority Data

May 20, 2021 (CN) ..... 202110552177.2

(51) Int. Cl.
*C25B 11/052* (2021.01)
*C25B 11/067* (2021.01)
*C25B 11/091* (2021.01)

(52) U.S. Cl.
CPC ..... *C25B 11/052* (2021.01); *C25B 11/067* (2021.01); *C25B 11/091* (2021.01)

(58) Field of Classification Search
CPC ... C25B 11/052; C25B 11/067; C25B 11/091; G01N 27/305
See application file for complete search history.

(56) References Cited

U.S. PATENT DOCUMENTS

2023/0035080 A1* 2/2023 Wu ..... A61K 41/0052

FOREIGN PATENT DOCUMENTS

CN 104874811 A 9/2015
CN 106944111 A * 7/2017
(Continued)

OTHER PUBLICATIONS

Zhang et al "Boosting visible-light-driven photocatalytic activity of BiPO4 via constructing Schottky Junction with Ti3C2 MXene" Materials and Design 192 (2020) 108772, p. 1-8. (Year: 2020).*
(Continued)

*Primary Examiner* — Nathan H Empie
(74) *Attorney, Agent, or Firm* — Bayramoglu Law Offices LLC

(57) ABSTRACT

A bismuth-doped bismuth phosphate photoelectrode modified by titanium carbide and a preparation method are provided. A first chitosan coating and a second chitosan coating both show electropositivity, and a two-dimensional $Ti_3C_2$ coating shows electronegativity, wherein the bismuth-doped bismuth phosphate photoelectrode modified by two-dimensional $Ti_3C_2$ is prepared by an electrostatic self-assembly method. The method is efficient, environment friendly and has simple operation steps; no precious metals are doped in reactions, and no pollutants are produced in reaction processes to meet a requirement of environmental protection; and the method has positive significance for putting the bismuth-doped bismuth phosphate photoelectrode modified by the titanium carbide into actual production. The bismuth-doped bismuth phosphate photoelectrode
(Continued)

enhances synergistic effect of electrons and delays recombination time of photo-induced electrons and hole pairs. A photocurrent response value of the bismuth-doped bismuth phosphate photoelectrode is about 410 times a photocurrent response value of a pure bismuth-doped bismuth phosphate photoelectrode.

6 Claims, 1 Drawing Sheet

(56) References Cited

FOREIGN PATENT DOCUMENTS

| | | | | |
|---|---|---|---|---|
| CN | 107037095 A | * | 8/2017 | ..... G01N 27/305 |
| CN | 109225287 A | | 1/2019 | |
| CN | 109507255 A | | 3/2019 | |
| CN | 110386602 A | | 10/2019 | |
| CN | 113237933 A | | 8/2021 | |

OTHER PUBLICATIONS

Pan et al "New Type of BiPO4 Oxy-Acid Salt Photocatalyst with high Photocatalytic Activity on Degradation of Dye." Environ. Sci. Technol. 2010, 44, 5570-5574. (Year: 2010).*

Liu et al "Layered BiOBr/Ti3C2 MXene composite with improved visible-light photocatalytic activity" J. Mater. Sci. (2019) 54:2458-2471. (Year: 2019).*

Xi et al "Facile synthesis of 2D Bi4O5Br2/2D thin layer-Ti3C2 for improved visible-light photocatalytic hydrogen evolution." J. of Solid State Chem. 289 (2020) 121470 p. 1-9 (Year: 2020).*

Jin et al "P Photocatalysis and UV-blocking properties of cotton fabric functionalized with BiPO4 nanorods" J Engineered Fibers and Fabrics 2019 V14: 1-8. (Year: 2019).*

* cited by examiner

BISMUTH-DOPED BISMUTH PHOSPHATE PHOTOELECTRODE MODIFIED BY TITANIUM CARBIDE AND PREPARATION METHOD

CROSS REFERENCE TO THE RELATED APPLICATIONS

This application is the national stage entry of International Application No. PCT/CN2021/133961, filed on Nov. 29, 2021, which is based upon and claims priority to Chinese Patent Application No. 202110552177.2, filed on May 20, 2021, the entire contents of which are incorporated herein by reference.

TECHNICAL FIELD

The present invention relates to the technical field of photoelectric catalytic materials, and particularly relates to a bismuth-doped bismuth phosphate photoelectrode modified by titanium carbide and a preparation method.

BACKGROUND

With the increasingly serious environmental pollution, the development of new energy technologies is imminent. In known new energy technology means, the reactant of a photoelectric catalytic hydrogen production technology is water, the catalytic condition is sunlight, and the product is clean hydrogen. Therefore, the photoelectric catalytic hydrogen production technology requires small energy consumption, and is generally regarded as a promising new energy means to improve environmental pollution.

Compared with traditional semiconductors, bismuth phosphate has an excellent photoresponse performance in an ultraviolet region because of its unique structure. However, the bismuth phosphate has inherent defects, and its band gap width ranges from 3.5 eV-4.6 eV. Because the band gap width is too low, only wavelengths in an ultraviolet range can be absorbed. In order to broaden the absorption wavelength of the bismuth phosphate to a visible region, bismuth can be doped in the bismuth phosphate. Compared with traditional precious metal-doped bismuth phosphate, bismuth-doped bismuth phosphate has the advantages of low price and easy availability of raw materials, and has positive economical and practical value.

In hot materials currently studied, transition metal carbides-MAXenes, have been widely studied due to the properties brought about by their unique structures. The MXene material is a kind of metal carbide or metal nitride material with a two-dimensional layered structure, and its shape is similar to stacked potato chips. Two-dimensional $Ti_3C_2$ has excellent dispersibility and stability due to its unique two-dimensional graphene sheet structure, and can be used as an adsorbent for dyes and a carrier for catalysts. Meanwhile, two-dimensional $Ti_3C_2$ has been considered as a concentrated and efficient photocatalyst, and can be combined with a base material so as to prolong the electron-hole pair lifetime of the base material, adjust the band gap and improve the ability to adsorb reactants. Therefore, the present invention uses two-dimensional $Ti_3C_2$ as a modification material to modify a bismuth-doped bismuth phosphate photoelectrode, in order to obtain an ideal photoelectrode material that can effectively improve the stability and photoresponse performance of the photoelectrode.

SUMMARY

The present invention aims to overcome the defects in the prior art and provide a bismuth-doped bismuth phosphate photoelectrode modified by titanium carbide and a preparation method. A chitosan first coating and a chitosan second coating both show electropositivity, and a two-dimensional $Ti_3C_2$ coating shows electronegativity, so that a bismuth-doped bismuth phosphate photoelectrode modified by two-dimensional $Ti_3C_2$ is prepared by an electrostatic self-assembly method. The present invention has high economical efficiency and environmental friendliness and simple operation steps; no precious metals are doped in reactions, and no pollutants are produced in reaction processes, thereby meeting the requirement of environmental protection; and the present invention has positive significance for putting the bismuth-doped bismuth phosphate photoelectrode modified by titanium carbide into actual production. The bismuth-doped bismuth phosphate photoelectrode modified by titanium carbide, prepared by the method of the present invention, enhances the synergistic effect of electrons and delays the recombination time of photo-induced electrons and hole pairs. The photocurrent response value of the bismuth-doped bismuth phosphate photoelectrode modified by titanium carbide is about 410 times that of a pure bismuth-doped bismuth phosphate photoelectrode, and the photocurrent response stability of the bismuth-doped bismuth phosphate photoelectrode modified by titanium carbide is significantly improved.

In order to achieve the above objectives, the technical solution of the present invention designs a method for self-assembly preparation of a bismuth-doped bismuth phosphate photoelectrode modified by titanium carbide, including the following steps:

S1: preparing bismuth-doped bismuth phosphate by a hydrothermal method;

S2: putting the bismuth-doped bismuth phosphate prepared in step S1 into deionized water, and performing ultrasonic vibration treatment for 0.5-1 h to form a bismuth-doped bismuth phosphate suspension;

S3: weighing a certain mass of chitosan, dissolving the chitosan in an acetic acid solution with a mass fraction of 2-3% to form a chitosan solution (the mass fraction of the chitosan solution is 0.5-1%), and adjusting the chitosan solution to pH=5 with a 0.1 M sodium hydroxide solution;

S4: cleaning and drying ITO glass, taking a certain mass of the bismuth-doped bismuth phosphate suspension prepared in step S2, coating the bismuth-doped bismuth phosphate suspension on a conductive surface of the ITO glass, performing drying to form a bismuth-doped bismuth phosphate first coating, taking a certain mass of the bismuth-doped bismuth phosphate suspension prepared in step S2 again, coating the bismuth-doped bismuth phosphate suspension on an outer surface of the bismuth-doped bismuth phosphate first coating of the ITO glass, performing drying to form a bismuth-doped bismuth phosphate second coating, then taking a certain mass of the chitosan solution prepared in step S3, coating the chitosan solution on an outer surface of the bismuth-doped bismuth phosphate second coating of the ITO glass, and performing drying to form a chitosan first coating, thereby obtaining a bismuth-doped bismuth phosphate electrode; and S5: coating a certain mass of two-dimensional $Ti_3C_2$ solution on an outer surface of the chitosan first coating of the bismuth-doped bismuth phosphate electrode prepared in step S4, performing drying to form a two-dimensional $Ti_3C_2$ coating, then taking a certain mass of the chitosan solution prepared in step S3, coating the chitosan solution on an outer surface of the two-dimensional $Ti_3C_2$ coating of the ITO glass, and performing drying to form a chitosan second coating, thereby obtaining a bismuth-doped bismuth phosphate photoelectrode modified by titanium carbide.

In the step S4, the bismuth-doped bismuth phosphate coating volume corresponding to the bismuth-doped bismuth phosphate first coating is 1-5 g/m 2, the bismuth-doped bismuth phosphate coating volume corresponding to the bismuth-doped bismuth phosphate second coating is 1-5 g/m 2, and the chitosan coating volume corresponding to the chitosan first coating is 1-2 $g/m^2$; and in the step S4, the two-dimensional $Ti_3C_2$ coating volume corresponding to the two-dimensional $Ti_3C_2$ coating is 0.2-1 $g/m^2$, and the chitosan coating volume corresponding to the chitosan second coating is 1-2 $g/m^2$, where the coating volume of each coating is an effective coating volume corresponding to the dried coating.

A preferred technical solution is: the specific operation of the step S1 includes: respectively weighing 1 mmol of bismuth nitrate pentahydrate, 1 mmol of sodium dihydrogen phosphate dihydrate and 1 mmol of glucose, putting the bismuth nitrate pentahydrate, the sodium dihydrogen phosphate dihydrate and the glucose in a container containing 15 mL of ethylene glycol, and performing ultrasonic vibration treatment for 2-4 h to form a reaction raw material suspension; transferring the reaction raw material suspension into a 20 mL Teflon-lined stainless steel autoclave, sealing the stainless steel autoclave, and then, putting the sealed stainless steel autoclave into a muffle furnace to react for 24-120 h at a temperature of 140-170° C.; and taking out the Teflon-lined stainless steel autoclave, cooling the autoclave to a room temperature, performing high-speed centrifugation on the reactant mixed solution to collect samples, washing the samples with absolute ethanol and deionized water until the solvent is removed completely, and putting the cleaned solids into a drying box for drying for 3-6 h at a temperature of 150-170° C., thereby obtaining bismuth-doped bismuth phosphate black powder.

A further preferred technical solution is: in the step S2, the mass concentration of the bismuth-doped bismuth phosphate suspension is 10 mg/mL; and in the step S5, the mass concentration range of the two-dimensional $Ti_3C_2$ solution is 1-5 mg/mL.

Another objective of the present invention is to provide a bismuth-doped bismuth phosphate photoelectrode modified by titanium carbide. The bismuth-doped bismuth phosphate photoelectrode modified by titanium carbide is prepared by the above method for self-assembly preparation of a bismuth-doped bismuth phosphate photoelectrode modified by titanium carbide.

The present invention has the following advantages and beneficial effects:

1. In the preparation method of a bismuth-doped bismuth phosphate photoelectrode modified by titanium carbide, disclosed by the present invention, the chitosan first coating and the chitosan second coating both show electropositivity, and the two-dimensional $Ti_3C_2$ coating shows electronegativity, so that a bismuth-doped bismuth phosphate photoelectrode modified by two-dimensional $Ti_3C_2$ is prepared by an electrostatic self-assembly method. The method of the present invention has high economical efficiency and environmental friendliness and simple operation steps; no precious metals are doped in reactions, and no pollutants are produced in reaction processes, thereby meeting the requirement of environmental protection; and the present invention has positive significance for putting the bismuth-doped bismuth phosphate photoelectrode modified by titanium carbide into actual production.
2. Compared with traditional semiconductor electrode materials, the bismuth-doped bismuth phosphate photoelectrode modified by titanium carbide, prepared by the method for self-assembly preparation of a bismuth-doped bismuth phosphate photoelectrode modified by titanium carbide disclosed by the present invention, has stronger photocatalytic activity.
3. In the bismuth-doped bismuth phosphate photoelectrode modified by titanium carbide, prepared by the method for self-assembly preparation of a bismuth-doped bismuth phosphate photoelectrode modified by titanium carbide disclosed by the present invention, the titanium carbide has good electrical conductivity, so that the transfer ability of electrons in a system can be enhanced; and the titanium carbide also has the function of an electron storage pool, so that the recombination of photo-induced electrons and hole pairs of the bismuth-doped bismuth phosphate can be delayed. The photocurrent response value of the bismuth-doped bismuth phosphate photoelectrode modified by titanium carbide in the present invention is about 410 times that of a pure bismuth-doped bismuth phosphate photoelectrode, and the photocurrent response stability of the bismuth-doped bismuth phosphate photoelectrode modified by titanium carbide in the present invention is significantly improved.

DETAILED DESCRIPTION OF THE EMBODIMENTS

Figure 1:
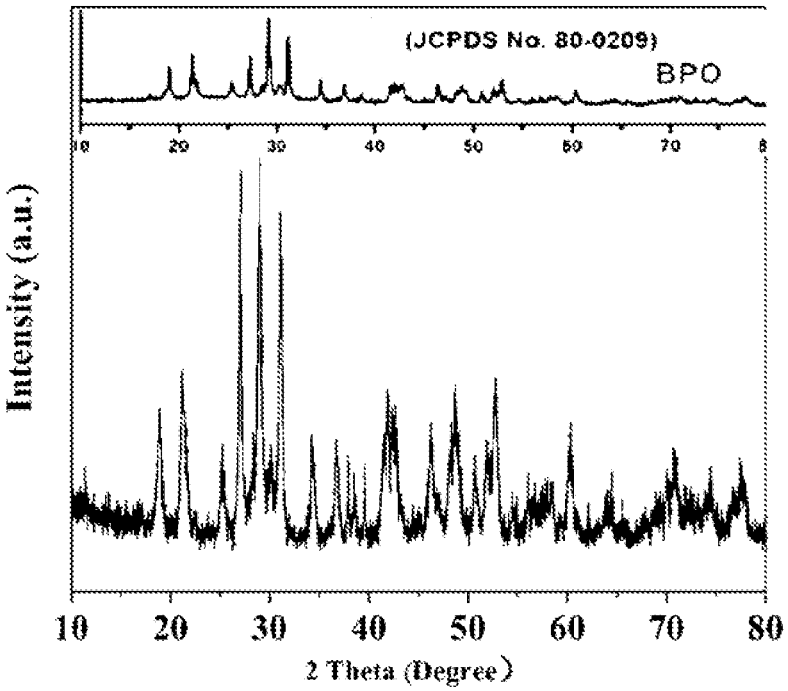
FIG. 1 is an X-ray diffraction (XRD) energy spectrum of the bismuth-doped bismuth phosphate prepared in Example 2.

The specific implementation modes of the present invention will be further described below with reference to the accompanying drawings and examples. The following examples are only used to illustrate the technical solutions of the present invention more clearly, and cannot be used to limit the protection scope of the present invention.

Example 1

A bismuth-doped bismuth phosphate photoelectrode modified by titanium carbide is prepared by a method for self-assembly preparation of a bismuth-doped bismuth phosphate photoelectrode modified by titanium carbide in the present invention. The method includes the following steps:

1. Preparation of Bismuth-Doped Bismuth Phosphate by Hydrothermal Method 1 mmol of bismuth nitrate pentahydrate, 1 mmol of sodium dihydrogen phosphate dihydrate and 1 mmol of glucose are weighed respectively and dissolved in 15 mL of ethylene glycol, and ultrasonic vibration treatment is performed by an ultrasonic cleaner for 2 h to form a reaction raw material suspension; the reaction raw material suspension is transferred into a 20 mL Teflon-lined stainless steel autoclave, the autoclave is sealed to react for 24 h at 140° C., and then, the autoclave is taken out and cooled to a room temperature; high-speed centrifugation is performed to collect solid samples, and the solid samples are washed with absolute ethanol and deionized water for 3 times until the solvent is completely cleaned; and the cleaned solid samples are dried in a drying box for 3 h at 150° C., so as to obtain bismuth-doped bismuth phosphate black powder.

2. Preparation of Bismuth-Doped Bismuth Phosphate Electrode 10 mg of bismuth-doped bismuth phosphate is weighed and dissolved in 1000 μL of deionized water, and ultrasonic treatment is performed by the ultrasonic cleaner for 0.5 h to form a uniform bismuth-doped bismuth phosphate suspension with a concentration of 10 mg/mL; ITO glass is respectively added to absolute ethanol and deionized water, cleaned with the ultrasonic cleaner, and then taken out and dried; 10 μL of the bismuth-doped bismuth phosphate suspension is weighed and coated on a conductive surface of the ITO glass, drying is performed by an infrared lamp to form a bismuth-doped bismuth phosphate first coating, 10 μL of the bismuth-doped bismuth phosphate suspension is coated on the ITO again, and drying is performed to form a bismuth-doped bismuth phosphate second coating; and in order to enable the bismuth-doped bismuth phosphate to uniformly form a film on the ITO, chitosan (showing positive charge) is dropwise added to an outer surface of the bismuth-doped bismuth phosphate second coating twice, 10 μL each time, and drying is performed to form a chitosan first coating, so as to obtain a bismuth-doped bismuth phosphate electrode, where the bismuth-doped bismuth phosphate coating volume corresponding to the bismuth-doped bismuth phosphate first coating is 1 $g/m^2$, the bismuth-doped bismuth phosphate coating volume corresponding to the bismuth-doped bismuth phosphate second coating is 1 $g/m^2$, and the chitosan coating volume corresponding to the chitosan first coating is 1 $g/m^2$.

The XRD data of the bismuth-doped bismuth phosphate black powder in Example 1 is consistent with the XRD spectrum of the bismuth-doped bismuth phosphate black powder in Example 2, which proves that the bismuth-doped bismuth phosphate is successfully prepared in Example 1.

3. Preparation of Bismuth-Doped Bismuth Phosphate Photoelectrode Modified by Titanium Carbide 100 μL of a two-dimensional $Ti_3C_2$ stock solution with a concentration of 5 mg/mL purchased from a manufacturer is weighed and added to 100 μL of deionized water to dilute the solution to 1 mg/mL; based on the effect of electrostatic adsorption, 20 μL of two-dimensional $Ti_3C_2$ (showing negative charge) is weighed and uniformly coated on a bismuth-doped bismuth phosphate photoelectrode, drying is performed to form a two-dimensional $Ti_3C_2$ coating, chitosan (positive charge) is dropwise added to a surface of the two-dimensional $Ti_3C_2$ coating twice, 10 μL each time, and drying is performed to form a chitosan second coating; and the chitosan second coating is put into a vacuum drying box for drying for 1 h at 40° C. under vacuum conditions, so as to obtain a bismuth-doped bismuth phosphate photoelectrode modified by self assembly of two-dimensional $Ti_3C_2$, namely a bismuth-doped bismuth phosphate photoelectrode modified by titanium carbide, where the two-dimensional $Ti_3C_2$ coating volume corresponding to the two-dimensional $Ti_3C_2$ coating is 0.2 $g/m^2$, and the chitosan coating volume corresponding to the chitosan second coating is 1 $g/m^2$.

Example 2

A bismuth-doped bismuth phosphate photoelectrode modified by titanium carbide is prepared by a method for self-assembly preparation of a bismuth-doped bismuth phosphate photoelectrode modified by titanium carbide in the present invention. The method includes the following steps:

1. Preparation of Bismuth-Doped Bismuth Phosphate by Hydrothermal Method 1 mmol of bismuth nitrate pentahydrate, 1 mmol of sodium dihydrogen phosphate dihydrate and 1 mmol of glucose are weighed respectively and dissolved in 15 mL of ethylene glycol, and ultrasonic vibration treatment is performed by an ultrasonic cleaner for 3 h to form a reaction raw material suspension; the reaction raw material suspension is transferred into a 20 mL Teflon-lined stainless steel autoclave, the autoclave is sealed to react for 96 h at 160° C., and then, the autoclave is taken out and cooled to a room temperature; high-speed centrifugation is performed to collect solid samples, and the solid samples are washed with absolute ethanol and deionized water for 3 times until the solvent is completely cleaned; and the cleaned solid samples are dried in a drying box for 5 h at 160° C., so as to obtain bismuth-doped bismuth phosphate black powder.

The XRD spectrum of the bismuth-doped bismuth phosphate black powder in Example 2 is shown in FIG. 1. FIG. 1 shows that the bismuth-doped bismuth phosphate prepared in Example 2 is basically consistent with a standard card JCPDS No. 80-0209, which proves that the bismuth-doped bismuth phosphate is successfully prepared in Example 2.

2. Preparation of Bismuth-Doped Bismuth Phosphate Electrode (Bi—$BiPO_4$)

10 mg of bismuth-doped bismuth phosphate is weighed and dissolved in 1000 μL of deionized water, and ultrasonic treatment is performed by the ultrasonic cleaner for 40 min to form a uniform bismuth-doped bismuth phosphate suspension with a concentration of 10 mg/mL; ITO glass is respectively added to absolute ethanol and deionized water, cleaned with the ultrasonic cleaner, and then taken out and dried; 10 μL of the bismuth-doped bismuth phosphate suspension is weighed and coated on a conductive surface of the ITO glass, drying is performed by an infrared lamp to form a bismuth-doped bismuth phosphate first coating, 10 μL of the bismuth-doped bismuth phosphate suspension is coated on the ITO again, and drying is performed to form a bismuth-doped bismuth phosphate second coating; and in order to enable the bismuth-doped bismuth phosphate to uniformly form a film on the ITO, chitosan (showing positive charge) is dropwise added to an outer surface of the bismuth-doped bismuth phosphate second coating twice, 10 μL each time, and drying is performed to form a chitosan first coating, so as to obtain a bismuth-doped bismuth phosphate electrode (Bi—$BiPO_4$), where the bismuth-doped bismuth phosphate coating volume corresponding to the bismuth-doped bismuth phosphate first coating is 2 $g/m^2$, the bismuth-doped bismuth phosphate coating volume corresponding to the bismuth-doped bismuth phosphate second coating is 2 $g/m^2$, and the chitosan coating volume corresponding to the chitosan first coating is 1.5 $g/m^2$.

3. Preparation of Bismuth-Doped Bismuth Phosphate Photoelectrode Modified by Titanium Carbide 100 μL of a two-dimensional $Ti_3C_2$ stock solution with a concentration of 5 mg/mL purchased from a manufacturer is weighed and added to 100 μL of deionized water to dilute the solution to 2.5 mg/mL; based on the effect of electrostatic adsorption, 20 μL of two-dimensional $Ti_3C_2$ (showing negative charge) is weighed and uniformly coated on a bismuth-doped bismuth phosphate photoelectrode, drying is performed to form a two-dimensional $Ti_3C_2$ coating, chitosan (positive charge) is dropwise added to a surface of the two-dimensional $Ti_3C_2$ coating twice, 10 μL each time, and drying is performed to form a chitosan second coating; and the chitosan second coating is put into a vacuum drying box for drying for 2 h at 50° C. under vacuum conditions, so as to obtain a bismuth-doped bismuth phosphate photoelectrode modified by self assembly of two-dimensional $Ti_3C_2$, namely a bismuth-doped bismuth phosphate photoelectrode modified by titanium carbide (abbreviated as $Ti_3C_2$—$BiPO_4$), where the two-dimensional $Ti_3C_2$ coating volume corresponding to the two-dimensional $Ti_3C_2$ coating is 0.5 g/m$^2$, and the chitosan coating volume corresponding to the chitosan second coating is 1.5 g/m$^2$.

Example 3

A bismuth-doped bismuth phosphate photoelectrode modified by titanium carbide is prepared by a method for self-assembly preparation of a bismuth-doped bismuth phosphate photoelectrode modified by titanium carbide in the present invention. The method includes the following steps:

1. Preparation of Bismuth-Doped Bismuth Phosphate by Hydrothermal Method 1 mmol of bismuth nitrate pentahydrate, 1 mmol of sodium dihydrogen phosphate dihydrate and 1 mmol of glucose are weighed respectively and dissolved in 15 mL of ethylene glycol, and ultrasonic vibration treatment is performed by an ultrasonic cleaner for 4 h to form a reaction raw material suspension; the reaction raw material suspension is transferred into a 20 mL Teflon-lined stainless steel autoclave, the autoclave is sealed to react for 120 h at 170° C., and then, the autoclave is taken out and cooled to a room temperature; high-speed centrifugation is performed to collect solid samples, and the solid samples are washed with absolute ethanol and deionized water for 3 times until the solvent is completely cleaned; and the cleaned solid samples are dried in a drying box for 6 h at 170° C., so as to obtain bismuth-doped bismuth phosphate black powder.

The XRD data of the bismuth-doped bismuth phosphate black powder in Example 3 is consistent with the XRD spectrum of the bismuth-doped bismuth phosphate black powder in Example 2, which proves that the bismuth-doped bismuth phosphate is successfully prepared in Example 3.

2. Preparation of Bismuth-Doped Bismuth Phosphate Electrode 10 mg of bismuth-doped bismuth phosphate is weighed and dissolved in 1000 μL of deionized water, and ultrasonic treatment is performed by the ultrasonic cleaner for 0.5 h to form a uniform bismuth-doped bismuth phosphate suspension with a concentration of 10 mg/mL; ITO glass is respectively added to absolute ethanol and deionized water, cleaned with the ultrasonic cleaner, and then taken out and dried; 10 μL of the bismuth-doped bismuth phosphate suspension is weighed and coated on a conductive surface of the ITO glass, drying is performed by an infrared lamp to form a bismuth-doped bismuth phosphate first coating, 10 μL of the bismuth-doped bismuth phosphate suspension is coated on the ITO again, and drying is performed to form a bismuth-doped bismuth phosphate second coating; and in order to enable the bismuth-doped bismuth phosphate to uniformly form a film on the ITO, chitosan (showing positive charge) is dropwise added to an outer surface of the bismuth-doped bismuth phosphate second coating twice, 10 μL each time, and drying is performed to form a chitosan first coating, so as to obtain a bismuth-doped bismuth phosphate electrode, where the bismuth-doped bismuth phosphate coating volume corresponding to the bismuth-doped bismuth phosphate first coating is 5 g/m$^2$, the bismuth-doped bismuth phosphate coating volume corresponding to the bismuth-doped bismuth phosphate second coating is 5 g/m$^2$, and the chitosan coating volume corresponding to the chitosan first coating is 2 g/m$^2$.

3. Preparation of Bismuth-Doped Bismuth Phosphate Photoelectrode Modified by Titanium Carbide ($Ti_3C_2$—$BiPO_4$)

100 μL of a two-dimensional $Ti_3C_2$ stock solution with a concentration of 5 mg/mL purchased from a manufacturer is weighed and added to 100 μL of deionized water to dilute the solution to 4.5 mg/mL; based on the effect of electrostatic adsorption, 20 μL of two-dimensional $Ti_3C_2$ (showing negative charge) is weighed and uniformly coated on a bismuth-doped bismuth phosphate photoelectrode, drying is performed to form a two-dimensional $Ti_3C_2$ coating, chitosan (positive charge) is dropwise added to a surface of the two-dimensional $Ti_3C_2$ coating twice, 10 μL each time, and drying is performed to form a chitosan second coating; and the chitosan second coating is put into a vacuum drying box for drying for 3 h at 60° C. under vacuum conditions, so as to obtain a bismuth-doped bismuth phosphate photoelectrode modified by self assembly of two-dimensional $Ti_3C_2$, namely a bismuth-doped bismuth phosphate photoelectrode modified by titanium carbide ($Ti_3C_2$—$BiPO_4$), where the two-dimensional $Ti_3C_2$ coating volume corresponding to the two-dimensional $Ti_3C_2$ coating is 1 g/m$^2$, and the chitosan coating volume corresponding to the chitosan second coating is 2 g/m$^2$.

Comparative Example 1

A preparation method of a bismuth-doped bismuth phosphate photoelectrode includes the following steps:

1. Preparation of Bismuth-Doped Bismuth Phosphate by Hydrothermal Method 1 mmol of bismuth nitrate pentahydrate, 1 mmol of sodium dihydrogen phosphate dihydrate and 1 mmol of glucose are weighed respectively and dissolved in 15 mL of ethylene glycol, and ultrasonic vibration treatment is performed by an ultrasonic cleaner for 3 h to form a reaction raw material suspension; the reaction raw material suspension is transferred into a 20 mL Teflon-lined stainless steel autoclave, the autoclave is sealed to react for 96 h at 160° C., and then, the autoclave is taken out and cooled to a room temperature; high-speed centrifugation is performed to collect solid samples, and the solid samples are washed with absolute ethanol and deionized water for 3 times until the solvent is completely cleaned; and the cleaned solid samples are dried in a drying box for 5 h at 160° C., so as to obtain bismuth-doped bismuth phosphate black powder.

The XRD data of the bismuth-doped bismuth phosphate black powder in Comparative Example is consistent with the XRD spectrum of the bismuth-doped bismuth phosphate black powder in Example 2, which proves that the bismuth-doped bismuth phosphate is successfully prepared in Comparative Example.

2. Preparation of Bismuth-Doped Bismuth Phosphate Electrode (Bi—$BiPO_4$)

10 mg of bismuth-doped bismuth phosphate is weighed and dissolved in 1000 μL of deionized water, and ultrasonic treatment is performed by the ultrasonic cleaner for 40 min to form a uniform bismuth-doped bismuth phosphate suspension with a concentration of 10 mg/mL; ITO glass is respectively added to absolute ethanol and deionized water, cleaned with the ultrasonic cleaner, and then taken out and dried; 10 μL of the bismuth-doped bismuth phosphate suspension is weighed and coated on a conductive surface of the ITO glass, drying is performed by an infrared lamp to form a bismuth-doped bismuth phosphate first coating, 10 μL of the bismuth-doped bismuth phosphate suspension is coated on the ITO again, and drying is performed to form a bismuth-doped bismuth phosphate second coating; and in order to enable the bismuth-doped bismuth phosphate to uniformly form a film on the ITO, chitosan (showing positive charge) is dropwise added to an outer surface of the bismuth-doped bismuth phosphate second coating twice, 10 μL each time, and drying is performed to form a chitosan first coating, so as to obtain a bismuth-doped bismuth phosphate electrode (Bi—$BiPO_4$), where the bismuth-doped bismuth phosphate coating volume corresponding to the bismuth-doped bismuth phosphate first coating is 2 g/$m^2$, the bismuth-doped bismuth phosphate coating volume corresponding to the bismuth-doped bismuth phosphate second coating is 2 g/$m^2$, and the chitosan coating volume corresponding to the chitosan first coating is 1.5 g/$m^2$.

In Examples 1-3 and Comparative Example 1, the coating volume of each coating is an effective coating volume corresponding to the dried coating.

Figure 2:
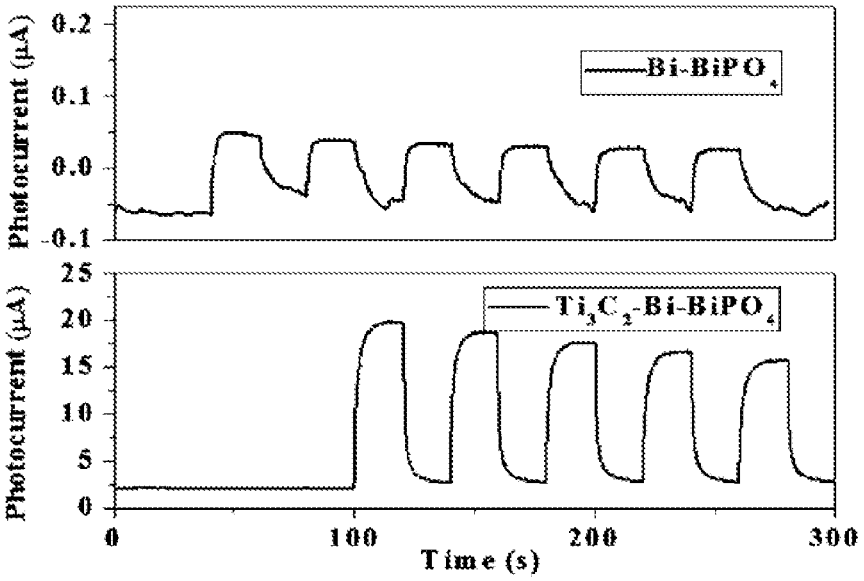
FIG. 2 is a photocurrent response spectrum of a bismuth-doped bismuth phosphate photoelectrode modified by titanium carbide prepared in Example 2.

The bismuth-doped bismuth phosphate photoelectrode modified by titanium carbide ($Ti_3C_2$—$BiPO_4$) prepared in Example 2 and the bismuth-doped bismuth phosphate electrode (Bi—$BiPO_4$) prepared in Comparative Example 1 are respectively subjected to a photocurrent response test, and test results are shown in FIG. 2. The data in FIG. 2 shows that the photocurrent response value of the bismuth-doped bismuth phosphate electrode (Bi—$BiPO_4$) prepared in Comparative Example 1 is 0.0385 μA, and the photocurrent response value of the bismuth-doped bismuth phosphate photoelectrode modified by titanium carbide ($Ti_3C_2$—$BiPO_4$) prepared in Example 2 is 15.524 μA, that is, the photocurrent response value of the bismuth-doped bismuth phosphate photoelectrode modified by titanium carbide ($Ti_3C_2$—$BiPO_4$) prepared in Example 2 is about 410 times that of the bismuth-doped bismuth phosphate photoelectrode (Bi—$BiPO_4$) prepared in Comparative Example 1, which indicates that the bismuth-doped bismuth phosphate photoelectrode ($Ti_3C_2$—$BiPO_4$) prepared by the method of the present invention has excellent photocurrent response characteristics and photocurrent response stability, and the objectives of the present invention are achieved.

The above examples are only the preferred examples of the present invention. It should be noted that those skilled in the art can make several improvements and modifications without departing from the technical principle of the present invention, and these improvements and modifications should also be regarded as the protection scope of the present invention.

What is claimed is:

1. A method for a self-assembly preparation of a bismuth-doped bismuth phosphate photoelectrode modified by titanium carbide, comprising the following steps:

S1: preparing bismuth-doped bismuth phosphate by a hydrothermal method;

S2: putting the bismuth-doped bismuth phosphate prepared in step S1 into deionized water, and performing an ultrasonic vibration treatment for 0.5-1 hour to form a bismuth-doped bismuth phosphate suspension;

S3: weighing a predetermined mass of chitosan, dissolving the chitosan in an acetic acid solution with a mass fraction of 2-3% to form a chitosan solution, wherein a mass fraction of the chitosan solution is 0.5-1%, and adjusting the chitosan solution to pH=5 with a 0.1 M sodium hydroxide solution;

S4: cleaning and drying an indium tin oxide (ITO) glass, taking a first predetermined mass of the bismuth-doped bismuth phosphate suspension prepared in step S2, coating the bismuth-doped bismuth phosphate suspension on a conductive surface of the ITO glass, performing drying to form a first bismuth-doped bismuth phosphate coating, taking a second predetermined mass of the bismuth-doped bismuth phosphate suspension prepared in step S2 again, coating the bismuth-doped bismuth phosphate suspension on an outer surface of the first bismuth-doped bismuth phosphate coating of the ITO glass, performing drying to form a second bismuth-doped bismuth phosphate coating, then taking a first predetermined mass of the chitosan solution prepared in step S3, coating the chitosan solution on an outer surface of the second bismuth-doped bismuth phosphate coating of the ITO glass, and performing drying to form a first chitosan coating to obtain a bismuth-doped bismuth phosphate electrode; and S5: coating a predetermined mass of a two-dimensional $Ti_3C_2$ solution on an outer surface of the first chitosan coating of the bismuth-doped bismuth phosphate electrode prepared in step S4, performing drying to form a two-dimensional $Ti_3C_2$ coating, then taking a second predetermined mass of the chitosan solution prepared in step S3, coating the chitosan solution on an outer surface of the two-dimensional $Ti_3C_2$ coating of the ITO glass, and performing drying to form a second chitosan coating to obtain the bismuth-doped bismuth phosphate photoelectrode modified by the titanium carbide, wherein in step S4, a bismuth-doped bismuth phosphate coating volume corresponding to the first bismuth-doped bismuth phosphate coating is 1-5 g/$m^2$, a bismuth-doped bismuth phosphate coating volume corresponding to the second bismuth-doped bismuth phosphate coating is 1-5 g/$m^2$, and a chitosan coating volume corresponding to the first chitosan coating is 1-2 g/$m^2$; and in step S4, a two-dimensional $Ti_3C_2$ coating volume corresponding to the two-dimensional $Ti_3C_2$ coating is 0.2-1 g/$m^2$, and a chitosan coating volume corresponding to the second chitosan coating is 1-2 g/$m^2$.

2. The method according to claim 1, wherein step S1 comprises:

respectively weighing 1 mmol of bismuth nitrate pentahydrate, 1 mmol of sodium dihydrogen phosphate dihydrate and 1 mmol of glucose, putting the bismuth nitrate pentahydrate, the sodium dihydrogen phosphate dihydrate and the glucose in a container containing 15 mL of ethylene glycol, and performing the ultrasonic vibration treatment for 2-4 hours to form a reaction raw material suspension;

transferring the reaction raw material suspension into a 20 mL Teflon-lined stainless steel autoclave, sealing the 20 mL Teflon-lined stainless steel autoclave to obtain a sealed 20 mL Teflon-lined stainless steel autoclave, and then, putting the sealed 20 mL Teflon-lined stainless steel autoclave into a muffle furnace to react for 24-120 hours at a temperature of 140-170° C.; and taking out the sealed 20 mL Teflon-lined stainless steel autoclave, cooling the sealed 20 mL Teflon-lined stainless steel autoclave to a room temperature, performing a high-speed centrifugation on a reactant mixed solution to collect samples, washing the samples with absolute ethanol and the deionized water until a solvent is removed completely, and putting cleaned solids into a drying box for drying for 3-6 hours at a temperature of 150-170° C. to obtain a bismuth-doped bismuth phosphate black powder.

3. The method according to claim 1, wherein in step S2, a mass concentration of the bismuth-doped bismuth phosphate suspension is 10 mg/mL; and in step S5, a mass concentration range of the two-dimensional $Ti_3C_2$ solution is 1-5 mg/mL.

4. A bismuth-doped bismuth phosphate photoelectrode modified by titanium carbide, wherein the bismuth-doped bismuth phosphate photoelectrode modified by the titanium carbide is prepared by the method according to claim 1.

5. The bismuth-doped bismuth phosphate photoelectrode according to claim 4, wherein step S1 comprises:

respectively weighing 1 mmol of bismuth nitrate pentahydrate, 1 mmol of sodium dihydrogen phosphate dihydrate and 1 mmol of glucose, putting the bismuth nitrate pentahydrate, the sodium dihydrogen phosphate dihydrate and the glucose in a container containing 15 mL of ethylene glycol, and performing the ultrasonic vibration treatment for 2-4 hours to form a reaction raw material suspension;

transferring the reaction raw material suspension into a 20 mL Teflon-lined stainless steel autoclave, sealing the 20 mL Teflon-lined stainless steel autoclave to obtain a sealed 20 mL Teflon-lined stainless steel autoclave, and then, putting the sealed 20 mL Teflon-lined stainless steel autoclave into a muffle furnace to react for 24-120 hours at a temperature of 140-170° C.; and taking out the sealed 20 mL Teflon-lined stainless steel autoclave, cooling the sealed 20 mL Teflon-lined stainless steel autoclave to a room temperature, performing a high-speed centrifugation on a reactant mixed solution to collect samples, washing the samples with absolute ethanol and the deionized water until a solvent is removed completely, and putting cleaned solids into a drying box for drying for 3-6 hours at a temperature of 150-170° C. to obtain a bismuth-doped bismuth phosphate black powder.

6. The bismuth-doped bismuth phosphate photoelectrode according to claim 4, wherein in step S2, a mass concentration of the bismuth-doped bismuth phosphate suspension is 10 mg/ml; and in step S5, a mass concentration range of the two-dimensional $Ti_3C_2$ solution is 1-5 mg/mL.

* * * * *